United States Patent [19]

Gorran

[11] 4,121,310

[45] Oct. 24, 1978

[54] FLOTATION SUPPORT SYSTEM WITH FLUID ACCUMULATION MEANS

[75] Inventor: Jody A. Gorran, East Windsor, N.J.

[73] Assignee: Medpro, Inc., East Brunswick, N.J.

[21] Appl. No.: 836,435

[22] Filed: Sep. 26, 1977

Related U.S. Application Data

[63] Continuation-in-part of Ser. No. 696,590, Jun. 16, 1976, Pat. No. 4,065,819.

[51] Int. Cl.[2] ..... A47G 9/00; A47C 27/08

[52] U.S. Cl. ..... 5/370; 5/371; 5/92; 5/349

[58] Field of Search ..... 5/92, 93, 349, 350, 5/368, 371

[56] References Cited

U.S. PATENT DOCUMENTS

| | | | |
|---|---|---|---|
| 2,870,461 | 1/1959 | Rosenthal | 5/93 |
| 3,702,484 | 11/1972 | Tobinick et al. | 5/370 |
| 3,983,587 | 10/1976 | Gorran | 5/370 |

*Primary Examiner*—Casmir A. Nunberg
*Attorney, Agent, or Firm*—Weingram & Klauber

[57] ABSTRACT

A flotation support system is disclosed, which includes a generally rectangular air frame, defined by a tubular air-filled member, which member surrounds an open region. A base sheet extends beneath the open region to define with the air-filled member a nesting receptacle for a fluid-containing envelope. Means are provided for spacing the envelope above the underlying base sheet, so that the space between the envelope and base sheet may define an accumulation space for fluid leaking from the envelope. Such spacing means may comprise a platform positioned in the nesting receptacle with an upper surface thereof underlying and supporting the envelope in spaced relationship from the base sheet. The platform may include passages to enable fluid flow to the accumulation space defined between the platform surface and base sheet, whereby leakage from the envelope may flow to the said space to prevent undesired collection of leaked fluid about the edges or above the envelope.

9 Claims, 6 Drawing Figures

FLOTATION SUPPORT SYSTEM WITH FLUID ACCUMULATION MEANS

This application is a continuation-in-part of my copending application Ser. No. 696,590 filed June 16, 1976, now U.S. Pat. No. 4,065,819 and entitled FLOTATION SUPPORT SYSTEM.

BACKGROUND OF THE INVENTION

This invention relates generally to cushioning structures, and more specifically relates to a flotation support system.

Flotation support systems such as mattress assemblies, including fluid-containing envelopes or other containers for supporting an individual, have achieved a wide degree of commercial success within recent years. Such devices are desirable not only by virtue of the comfort afforded the user thereof; but they further have been deemed valuable from a therapeutic viewpoint — for use particularly with patients who, for one reason or another, are confined to bed for long periods, or who have only limited mobility. It is thus known that patients maintained under such conditions are subject to development of tissue breakdowns, which result in decubitus ulcers — commonly known as bed sores. Cushioning devices based upon fluid support principles are valuable for these applications in that it is thereby possible to introduce a high degree of compliance to the surface upon which the individual rests, thereby uniformly spreading the reaction pressure over an extended area of tissue. The said fluid may comprise air; but preferably a liquid or gel is employed.

In my aforementioned Ser. No. 696,590 application, a flotation system is provided which is useful in a variety of applications, including especially as a system for use with infants, e.g., as an infant bed, etc. The said flotation system includes a generally rectangular air frame, which is defined by a tubular air-filled member surrounding an open region. A base sheet extends beneath the open region, and is secured to the tubular member to define with such member a nesting receptacle for a fluid-containing envelope. The base sheet passes beneath and is secured to the tubular member toward the outer peripheral border thereof to provide a receiving slot between the lower side of the tubular member and the adjacent portions of the sheet. The envelope has dimensions exceeding that of the open region so that the peripheral portions of the envelope are receivable into the said slot. The peripheral portion of the envelope are elastically constrained by the slot to thereby constitute a buffer volume for liquid displaced from the central portions of the envelope in consequence of the individual being emplaced upon the central portion, to thereby provide improved cushioning characteristics. The air frame also acts as a restraining bumper which renders the assembly ideal for use in cribs or in other applications wherein the infants residing on the assembly would be in danger of falling from same.

Both in devices of the aforementioned type, as well as in other flotation systems of the general type including a perimeter frame which surrounds and thereby defines a fluid-tight nesting receptacle for receipt of a fluid-containing envelope, a particular difficulty that has been experienced — and one which causes a great deal of concern — arises where leakage occurs in the fluid-containing envelope. The fluid is typically water or the like, and should a leak occur from damage or wear and tear, liquid can begin to accumulate in and about the fluid envelope, and in particular above the envelope, i.e., on the upper surfaces of same, or upon or about the covering element if the latter overlies the envelope.

In the case of an adult the foregoing problem is an inconvenience, but not a danger. In the case of an infant, however, whose movements are severely restricted, the foregoing condition represents a highly perilous circumstance. Indeed it is possible for the infant to be injured or even drowned in the relatively small pools of liquid which can accumulate in consequence of the foregoing.

SUMMARY OF INVENTION

Now in accordance with the present invention, an improved flotation support system is disclosed, which system is of the general type including a perimeter frame which surrounds and thereby defines a water-tight recess or nesting receptacle for a fluid-containing envelope. A frame of this type may, e.g., be formed from a foam block, i.e., of plastic, or of wood or so forth, which includes a recessed central space for receipt of the aforementioned envelope; or similarly the frame may comprise a series of beams of wood, plastic or other material defining the said perimeter, which beams surround a water-tight recessed central portion — which defines the aforementioned nesting receptacle for the fluid-containing envelope.

The flotation support system preferably, however, is defined by a tubular air-filled member which surrounds an open region. In this instance a base sheet or the like extends beneath the open region to define with the air-filled member the fluid-tight nesting receptacle for the fluid-containing envelope.

Pursuant to the invention, means are provided for spacing the fluid-containing envelope above the floor of the aforementioned recess or nesting receptacle, so that the space between the envelope and recessed floor may define an accumulation space for fluid leaking from the envelope. Such spacing means preferably comprises a platform positioned in the nesting receptacle with an upper surface thereof underlying and supporting the envelope in the aforementioned spaced relationship with respect to the floor of the recess. The platform means preferably includes passages to enable fluid flow to the accumulation space defined between the platform surface, and floor of the recess, whereby leakage from the envelope may flow to the accumulation space to prevent undesired collection of leaked fluid above and about the envelope. Such passages may comprise simple openings or the like present in the surface of the platform.

Where the flotation support system comprises the aforementioned air-filled member and underlying base sheet, the platform may be positioned in the nesting receptacle with its upper surface underlying and supporting the envelope in the aforementioned spaced relationship with respect to the mentioned base sheet. In this instance the passages in the platform means enable fluid flow to the accumulation space defined between the platform surface and the base sheet.

BRIEF DESCRIPTION OF DRAWINGS

The invention is diagrammatically illustrated by way of example in the drawings appended hereto, in which.

DESCRIPTION OF PREFERRED EMBODIMENT

Figure 1:
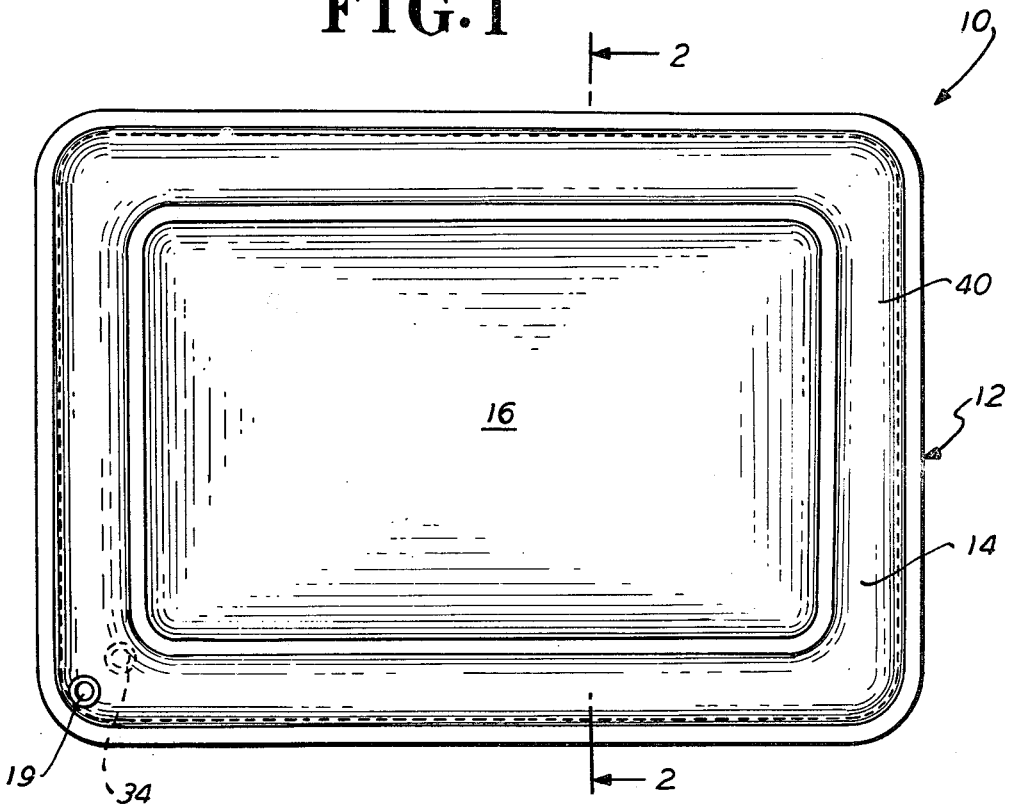
FIG. 1 is a top plan view of a flotation support system in accordance with the present invention.

In FIG. 1 herein, a top plan view appears of a flotation support system 10 in accordance with the present invention. The view of FIG. 1 may be considered simultaneously with the cross-sectional view of FIG. 2 in order to fully appreciate the structure of the present device.

System 10 is seen to consist of a generally rectangular air frame 12, which is defined by a tubular air-filled member 14, which surrounds an open region 16. Tubular member 14 may extend continuously as an open tube about the periphery of the structure, and may be formed from top and bottom pieces 15 and 13 of polyvinyl chloride, or similar tough thermoplastic, which are heat-sealed to one another along their inner and outer lateral edges 18 and 20. The said lateral edges 18 and 20, thus extend completely about the said frame at the inner and outer borders thereof.

The tubular member 14 is collapsible and is normally filled with air through a valve means 19, which is of conventional construction. A typical valve suitable for such purposes is, for example, available from Halkey-Roberts Company of Paramus, N. J., under the product designation "550-AC."

A fluid impervious base sheet 22, which again may comprise a heat-sealable thermoplastic such as the mentioned polyvinyl chloride, extends beneath the open region 16, and is secured to the tubular member about the entire periphery thereof to define with such member a nesting receptacle for a fluid-containing envelope 24. In accordance with one aspect of the present invention, the base sheet 22 is preferably secured to tubular member 14 by sealing the sheet to a portion of tubular member 14 toward the outer peripheral border thereof. Thus, as best seen in the cross-sectional view of FIG. 2, the sheet 22 is preferably secured, as by heat-seaing, to the outer lateral edge 20 of the said tubular member. In consequence of this arrangement it will be clear that a receiving slot 26 is defined between the lower portion 13 of tubular member 14, and the portion 28 of the base sheet 22 which resides between the attachment area at edge 20 and the open region 16. The function of this receiving slot 26, which thus extends completely about and borders the open region 16, will become clear hereinbelow.

Fluid envelope 24, is per se a conventional device, which may comprise upper and lower layers 30 and 32 of a fluid impervious material such as the polyvinyl chloride plastic previously mentioned, which layers are sealed to one another along their lateral edges 33.

Like the tubular member 14, the fluid-filled envelope 24 is collapsible, and valve means 34, which again are of conventional construction, are utilized for providing a fluid to or from the interior of the said envelope. The fluid contained in envelope 24 preferably comprises a liquid such as water; but other liquids, including materials of greater or lesser viscocity than water may be utilized; and similarly, other flowable and semi-flowable materials, including gels, slurries, etc., may be used for filling the interior envelope 24. The valve 34 previously mentioned, may comprise a conventional device, including an auxiliary flapper valve feature, such as the Roberts 10-10AF valve, available from the aforementioned Halkey-Roberts Company.

Pursuant to a principal aspect of the present invention, it will be seen that a spacing means generally designated by reference numeral 45 is now provided, which spacing means is positioned beneath envelope 24 so as to raise the latter with respect to the underlying base sheet 22, thereby to define an accumulation space 47 between envelope 24 and the spaced sheet 22. The spacing means 45 can be seen in cross-sectional view in both FIGS. 2 and 3, and preferred embodiments of same appear in the perspective views of FIGS. 4 through 6.

Figure 4:
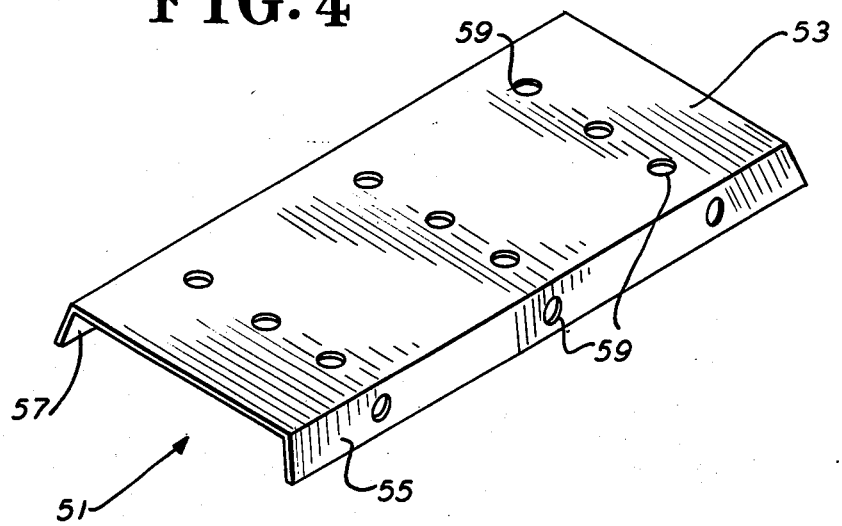
FIG. 4 is a perspective view of a platform means utilizable as the spacing means pursuant to the present invention.

Referring to FIG. 4 a first embodiment of means 45 is illustrated. Such means is seen therein to take the form of an elevating platform 51, which can be of one-piece construction, e.g., formed of plastic, metal, or the like. If of plastic, the said piece may simply constitute a direct one-piece molding. Platform 51 is thus seen to include an upper surface portion 53, and downwardly directed support leg portions 55 and 57, so that the general cross-sectional configuration of platform 51 is substantially an inverted U. Both the upper surface 53 and the side support leg portions 55 and 57, are seen to be provided with openings or passageways 59 passing through the said elevating platform 51.

Figure 2:
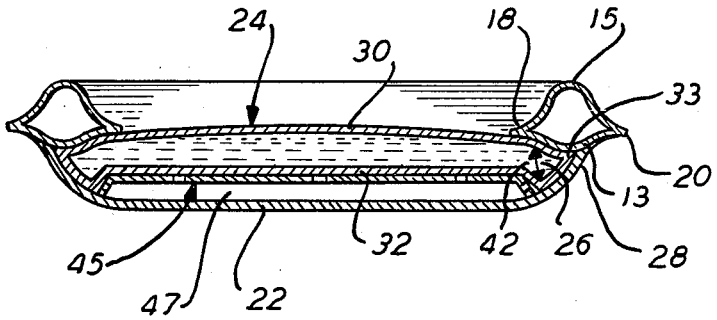
FIG. 2 is a cross-sectional view through the device of FIG. 1, taken along the line 2—2 of the said Figure.
Figure 3:
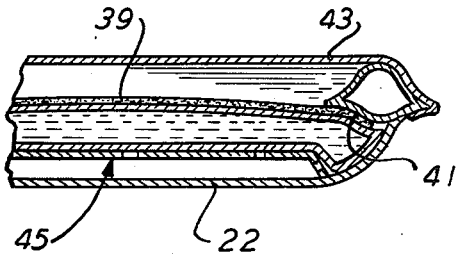
FIG. 3 is a fragmentary cross-sectional view similar to FIG. 2, and depicting additional features that may be incorporated into the present device.

By reference to FIGS. 2 and 3 the purpose of the present construction will be clear. In particular should a leak develop from envelope 24, for example, by virtue of damage of the envelope or by simple wear and tear, the fluid contained therein (commonly water) will simply flow through the passages 59 into the underlying accumulation space 47, thus assuring that the liquid cannot accumulate to any appreciable extent as pools in or about envelope 24, and especially upon the upper surface thereof. Indeed the accumulation space 47 is of sufficient volume to assure that all the liquid contained within envelope 24 can be received in space 47 so that there is substantially no danger of liquid accumulating above or at the upwardly facing surfaces of the envelope — as to thereby present a danger to the infant residing upon the envelope.

Figure 5:
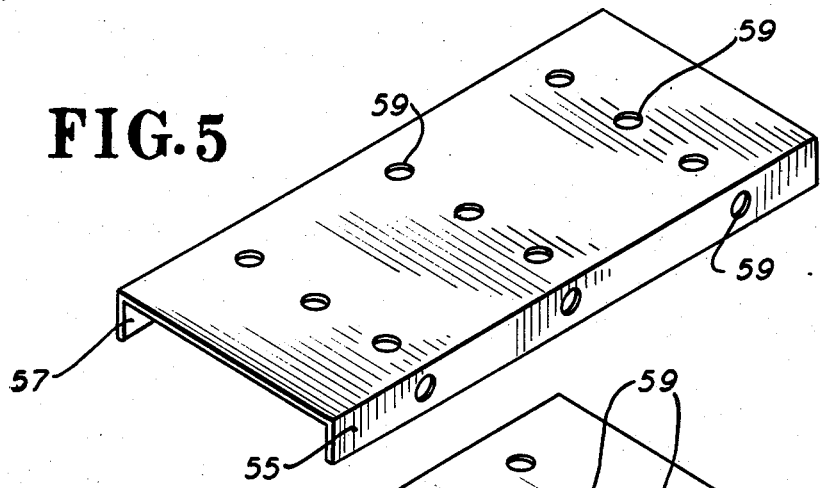
FIG. 5 is a perspective view of a further embodiment of a platform means pursuant to the present invention.

In FIG. 5 a variation upon the embodiment of FIG. 4 is set forth. The device shown therein is essentially similar to that of FIG. 4, except that the leg support portions 55 and 57, instead of being somewhat outwardly angled with respect to support surface 53, are essentially perpendicular with respect thereto.

Figure 6:
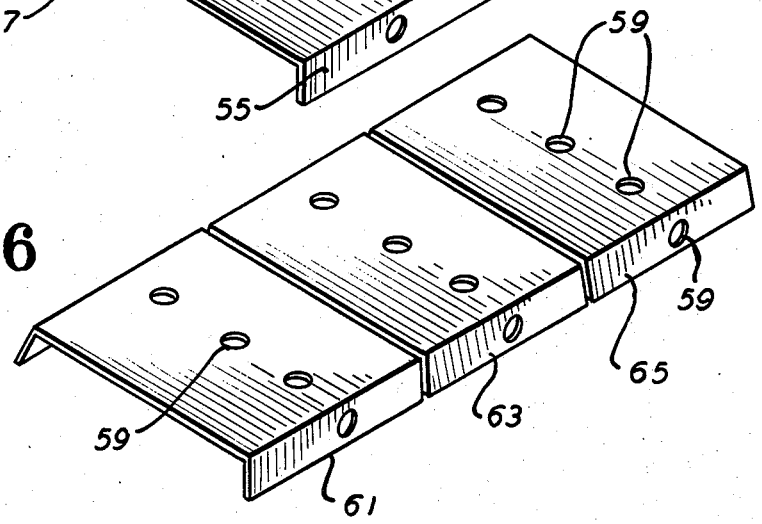
FIG. 6 represents a further embodiment of the platform means constituting a spacing means pursuant to the present invention.

In FIG. 6 a yet further embodiment of the platform 51 is shown. In this instance elevating platform 51 consists of a plurality of side-by-side elevating platform units 61, 63 and 66. These are simply positioned in an end-to-end relationship beneath the water or other fluid-containing envelope 24, whereupon they act in the manner previously discussed. The advantage of the modular arrangement of FIG. 6 is that the embodiment there shown can be readily utilized with differing size envelopes or so forth. It is also simpler to emplace the elevating platform in the overall assembly where modular components are used, as a less bulky devise is presented for emplacement.

By considering the cross-sectional view of FIG. 2 simultaneously with FIG. 1, further attributes of the present invention may now be appreciated. In particular, it will be seen that the receiving slot structure 26 previously mentioned, thus assures that the periphery 40 (FIG. 1) of envelope 24, resides well within the said slot, and in particular, well under the bulk of tubular member 14. Several important consequences flow from such arrangement. Among these is the fact that the fluid envelope 24 is firmly positioned and stabilized within the frame 12. A further significant consideration, is that the construction enables use of a fluid envelope 24 having relatively large dimensions. This in turn enables the fluid envelope 24 (which is in no way fixedly secured within the remainder of the appliance) to be removed and utilized (if desired) as a separate "mattress" in its own right. Were the dimensions of envelope 24 limited to those of the open region 16, it will be evident that the size of envelope 24 would be too limited to enable this separate use.

The fact that envelope 24 is indeed of dimensions comparable to those of frame 12, has another significant corollary. This is that present water envelopes, i.e., those already in use atop given bed frames, are dimensionally compatible with the present assembly. In particular, many water envelopes now in use are basically similar to envelope 24. Assuming that a user desires to employ assembly 10 on a given bed or crib, he need only choose the present tubular frame 12 as to have approximate dimensions compatible with his existing bed frame. The water envelope which may already be in use on the bed frame (even though its dimensions are approximately those of the bed frame) will now fit quite readily into tubular frame 12.

It may, incidentally, be observed that the very fact that fluid envelope 24 is separate from frame 12 and overlies fluid impervious sheet 22, assures that spillage of fluid will not occur from system 10, should a leak develop in envelope 24.

A further advantage of the present arrangement derives from the fact that the portions of fluid envelope 24 held within receiving slot 26, are in effect elastically constrained therein. This is to say that while the top-to-bottom spacing 42 of such portion is constrained by slot 26, it is yet clear that spacing 42 is quite variable due to the elasticity of the slot boundaries. Accordingly, the lateral portions 40 of envelope 24 constitute a buffer volume, from which and to which, fluid may readily flow from other portions of the envelope.

Thus, in particular, it will be evident that when an individual is emplaced upon the present system, fluid may readily be displaced from the central portions of the fluid envelope 24 toward the buffer volume defined by the lateral portions 40 of the envelope which are within slot 26. Similarly it will be evident, that the elastic constraint present about these lateral portions, tend to cause fluid to flow back into central portions of the envelope when pressure is diminished by the individual shifting his weight, etc. The net effect of this arrangement, is to considerably improve the nature of the cushioning effect provided by the present device, vis-a-vis prior constructions.

Referring particularly to the cross-sectional view of FIG. 2, a further aspect of the present invention may be appreciated. In particular, it will be seen that the uppermost portions 35 of tubular frame 14, reside well above the uppermost portion 37 of the fluid-containing envelope 24. The uppermost portions 35 of the said tubular frame, further are seen to be well above the adjacent portions of envelope 24, i.e., the lateral boundary portions 40 of envelope 24 which are, as already mentioned, contained within slot 26. The tubular member, therefore, serves in the nature of a protective bumper or resillient guard rail. This function of member 14 is significant when the present system is utilized in a crib or in similar environment wherein the individual utilizing same is either an infant or is in an enfeebled condition necessitating some sort of restraining mechanism which acts to prevent an individual from toppling without the assembly.

The slot 26, in addition to performing the functions heretofore discussed, provides a further function which is best illustrated in the fragmentary cross-sectional view of FIG. 3. This view is taken along the same direction as that of FIG. 2, except that two additional elements have been added to the device of FIG. 2. In particular, it will be seen that an insulation pad 39 has now been positioned atop the water envelope 24. Insulation pad 39 can be any conventional device of this nature, comprising cloth, foam rubber or so forth. The said pad is not fixedly secured to envelope 24, but rather is contiguous to same, i.e., simply placed atop said envelope. The lateral edges 41 of the said pad, however, are commonly retained within slot 26 along with the adjacent portions of the water envelope. Accordingly, the said slot serves to frictionally engage, and, to a limited degree, "clamp" the insulation pad in place to prevent its dislodgement — which could cause problems where infants or so forth, are placed atop the present device.

The said FIG. 3 also is seen to illustrate a resillient fluid-impervious covering member 43 which may be secured about the entire top portion of the system 10. Cover 43, which may comprise a resillient or stretchable fluid-impervious material, e.g., of PVC plastic, or rubber or so forth, is retained in place about the present structure by being stretched over the tubular frame 12, i.e., it is secured in such fashion by elastic bands or heat-sealed fitted corners being secured over the lateral edges 20 of the frame. The said cover 43 is very flexible and fluid-impervious as indicated; hence an individual emplaced upon system 10 may by this construction be further protected from the likelihood of becoming wet in the event of leakage of fluid from envelope 24.

While the present invention has been particularly set forth in terms of specific embodiments thereof, it will be understood in view of the present disclosure, that numerous variations upon the invention are now enabled to those skilled in the art, which variations yet reside within the teaching of the invention. Accordingly the invention is to be broadly construed, and limited only by the scope and spirit of the claims now appended hereto.

I claim:

1. A flotation support system, comprising in combination:

a perimeter frame surrounding a fluid-tight recessed nesting receptacle:

a liquid-containing envelope being positioned in said nesting receptacle; and rigid platform means positioned in said nesting receptacle, the top of said platform means supporting said envelope in spaced relationship above the underlying floor of said nesting receptacle, a space being defined between said platform means top and receptacle floor for accumulation of liquid leaking from said envelope.

2. A system in accordance with claim 1, wherein said frame comprises a generally rectangular air-filled member surrounding an open region; a base sheet extending beneath said open region, and being secured to said tubular member to thereby define with said member said fluid-tight nesting receptacle; the upper surface of said platform means supporting said envelope above said underlying base sheet whereby the space between said envelope and base sheet defines said accumulation space; and wherein said upper surface of said platform means includes flow passages for enabling said leaked liquid to flow to said accumulation space, to thereby preclude collection of leaked liquid above or about said envelope.

3. A device in accordance with claim 2, wherein said base sheet passes under said tubular member and is secured to said member toward the outer peripheral edge of said frame to thereby define with said member a nesting receptacle bounded by a receiving slot defined between the upper side of said sheet and the adjacent wall of said member; and wherein said envelope has dimensions exceeding those of said open region, and the peripheral border portions of said envelope are received into said receiving slot.

4. A device in accordance with claim 3, wherein the said peripheral portions of said envelope are elastically constrained by said slot, said portions thereby providing a buffer volume for volumes of fluid displaced from the portions of said envelope within said open region in consequence of the positioning of an individual thereupon.

5. A device in accordance with claim 2, wherein said platform means comprises an upwardly facing support surface for said envelope, and downwardly extending support leg portions.

6. A device in accordance with claim 5, wherein said platform is of one-piece construction.

7. A device in accordance with claim 5, wherein said platform is of a generally inverted U in cross section.

8. A device in accordance with claim 7, wherein said platform means comprises a series of end-to-end sections.

9. A device in accordance with claim 2, further including a fluid-impervious cover secured about at least the upper portions of said air frame, thereby covering said envelope to isolate an individual residing on said system from liquid leakage.

* * * * *